US010395443B2

(12) United States Patent
Nordbruch

(10) Patent No.: US 10,395,443 B2
(45) Date of Patent: Aug. 27, 2019

(54) TESTING FOR ERRORS OF A SENSOR SYSTEM FOR ACQUIRING A STATE OF OCCUPANCY OF A PARKING SPACE

(71) Applicant: Robert Bosch GmbH, Stuttgart (DE)

(72) Inventor: Stefan Nordbruch, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 56 days.

(21) Appl. No.: 15/818,927

(22) Filed: Nov. 21, 2017

(65) Prior Publication Data

US 2018/0158258 A1 Jun. 7, 2018

(30) Foreign Application Priority Data

Dec. 1, 2016 (DE) ..... 10 2016 223 973

(51) Int. Cl.
*G07C 5/08* (2006.01)

(52) U.S. Cl.
CPC ..... *G07C 5/0808* (2013.01)

(58) Field of Classification Search
CPC ..... G07C 5/0808; G01S 7/412; G01S 7/003; G01S 13/86; G01S 17/936; G01S 7/411; G01S 7/4802; G01S 7/539; G01S 2013/9314; G01S 2013/936; G01S 2013/9364; G01S 2013/9367; G01S 2013/9385; G08G 1/143
USPC ..... 701/30, 30.5
See application file for complete search history.

(56) References Cited

U.S. PATENT DOCUMENTS

2013/0262059 A1* 10/2013 Grbovic ..... G06Q 10/04 703/6
2014/0085112 A1* 3/2014 Gruteser ..... B60Q 9/004 340/932.2
2015/0266490 A1* 9/2015 Coelingh ..... B60W 50/082 701/30.5

FOREIGN PATENT DOCUMENTS

DE 102014217567 A1 3/2016
EP 2136346 A2 12/2009

OTHER PUBLICATIONS

Lee, et al.: "Development of a Verification Method on Ultrasonic-based Perpendicular Parking Assist System", IEEE ISCE (2014) 1569942459.

* cited by examiner

*Primary Examiner* — Marthe Y Marc-Coleman
(74) *Attorney, Agent, or Firm* — Norton Rose Fulbright US LLP; Gerard Messina

(57) ABSTRACT

A method for testing for errors of a sensor system included in a motor vehicle for acquiring a state of occupancy of a parking space for motor vehicles. The method includes provision of a reference data set, ascertained independently of the sensor system to be tested, for a parking space, the reference data set including a reference state of occupancy of the parking space, acquisition of a state of occupancy of the parking space by the sensor system, and comparison of the acquired state of occupancy of the parking space with the reference state of occupancy in order to test the sensor system for errors.

10 Claims, 1 Drawing Sheet

TESTING FOR ERRORS OF A SENSOR SYSTEM FOR ACQUIRING A STATE OF OCCUPANCY OF A PARKING SPACE

CROSS REFERENCE

The present application claims the benefit under 35 U.S.C. § 119 of German Patent Application No. DE 102016223973.2 filed on Dec. 1, 2016, which is expressly incorporated herein by reference in its entirety.

FIELD

The present invention relates to a method and to a device for testing for errors of a sensor system included in a motor vehicle for acquiring a state of occupancy of a parking space for motor vehicles. In addition, the present invention relates to a motor vehicle and to a computer program.

BACKGROUND INFORMATION

German Patent Application No. DE 10 2014 217 567 A1 describes a method and a server for mapping a parking space.

European Patent Application No. EP 2 136 346 A2 describes a parking guidance system for navigating a vehicle looking for a parking space to an open parking space.

SUMMARY

An object of the present invention is to provide a design for the efficient testing for errors of a sensor system included in a motor vehicle for acquiring a state of occupancy of a parking space for motor vehicles.

Advantageous embodiments of the present invention are described herein.

According to an aspect of the present invention, a method is provided for testing for errors of a sensor system included in a motor vehicle for acquiring a state of occupancy of a parking space for motor vehicles, the method including the following steps:

- provision of a reference data set, ascertained independently of the sensor system to be tested, for a parking space, the reference data set including a reference state of occupancy of the parking space,
- acquisition of a state of occupancy of the parking space using the sensor system, and
- comparison of the acquired state of occupancy of the parking space to the reference state of occupancy in order to test the sensor system for errors.

According to a further aspect, a device is provided for testing for errors of a sensor system included in a motor vehicle for acquiring a state of occupancy of a parking space for motor vehicles, the device being fashioned to carry out the method for testing a sensor system included in a motor vehicle for acquiring a state of occupancy of a parking space for motor vehicles.

According to a further aspect, a motor vehicle is provided that includes the device for testing for errors of a sensor system included in a motor vehicle for acquiring a state of occupancy of a parking space for motor vehicles.

According to a further aspect, a computer program is provided that includes program code for carrying out the method for testing for errors of a sensor system included in a motor vehicle for acquiring a state of occupancy of a parking space for motor vehicles when the computer program is executed on a computer.

The present invention is based on the finding that the above task can be solved by comparing a state of occupancy of a parking space acquired by the sensor system with a reference state of occupancy of the parking space.

If the comparison yields the result that the acquired state of occupancy agrees with the reference state of occupancy, it is determined or decided that the sensor system is operating correctly, i.e., that no error has occurred.

If the comparison yields the result that the acquired state of occupancy and the reference state of occupancy are different from one another, i.e., do not agree, i.e., are unequal, it is determined or decided that the sensor system is operating incorrectly, i.e., that an error has occurred.

In this way, for example the technical advantage is achieved that an error in the sensor system can be efficiently recognized. In particular, in this way the technical advantage is achieved that it can be efficiently tested whether the sensor system can acquire the correct state of occupancy of the parking space.

In this way, in particular the technical advantage is achieved that a design is provided for the efficient testing for errors of a sensor system included in a motor vehicle for acquiring a state of occupancy of a parking space for motor vehicles.

The fact that the reference data set, including the reference state of occupancy, was ascertained independently of the sensor system means in particular that the reference data set was not ascertained by the sensor system, and/or that data ascertained by the sensor system, these data including for example a state of occupancy, were not used for the ascertaining of the reference data set.

The reference data set was for example ascertained using sensor systems of other motor vehicles. The reference data set was for example ascertained using data including a state of occupancy, these data having been collected by persons.

Data of the reference data set, i.e., in particular the reference state of occupancy, are thus data for which it has been determined or defined, and/or for which it is assumed, that they are free of error.

Thus, if the sensor system to be tested is operating correctly, it should acquire the state of occupancy corresponding to the reference state of occupancy. If this is not the case, then it must be assumed that the sensor system to be tested is operating incorrectly.

In the sense of the description herein, a state of occupancy indicates whether the parking space is occupied or unoccupied, i.e., open.

According to a specific embodiment, the acquiring of the state of occupancy of the parking space is carried out while the motor vehicle is driving past the parking space.

In a specific embodiment, the sensor system to be tested includes one or more of the following environmental sensors for acquiring a surrounding environment of the motor vehicle: ultrasound sensor, lidar sensor, laser sensor, magnetic sensor, radar sensor, video sensor, in particular a video sensor of a video camera.

The environmental sensor acquires in particular the parking space, the state of occupancy of the parking space in particular being ascertained based on this acquisition.

For example, an image analysis is carried out of video data of the video camera in order to ascertain the state of occupancy of the parking space.

For example, an analysis of radar data of the radar sensor is carried out in order to ascertain the state of occupancy of the parking space.

Thus, in general for example an analysis is carried out of environmental sensor data that correspond to an acquired surrounding environment in order to ascertain the state of occupancy of the parking space.

In a specific embodiment, it is provided that the reference data set includes a reference position of the parking space, a position of the parking space being acquired by the sensor system, the acquired position of the parking space being compared with the reference position in order to test the sensor system for errors.

In this way, for example the technical advantage is achieved that it can be efficiently tested whether the sensor system to be tested can correctly ascertain the position of the parking space.

In a specific embodiment, it is provided that the sensor system includes a position sensor, for example a GPS sensor, for determining the position of the parking space. It is to be noted that the position sensor actually determines the position of the sensor system. However, in the present description it is assumed that the spatial nearness of the sensor system to the parking space during the acquisition of the state of occupancy is such that, to a first approximation, the position of the sensor system corresponds to the position of the parking space (see also statements below).

In a further specific embodiment, it is provided that the reference data set includes a reference dimension of the parking space, a dimension of the parking space being acquired by the sensor system, the acquired dimension of the parking space being compared with the reference dimension in order to test the sensor system for errors.

In this way, for example the technical advantage is achieved that it can be efficiently tested whether the sensor system to be tested can correctly ascertain the dimension of the parking space.

A dimension is for example a length or a height or a width of the parking space.

For example, the reference data set includes a plurality of dimensions.

Statements made in connection with a dimension hold analogously for a plurality of dimensions, and vice versa.

In general, in the present description, when "dimension" is used in the singular the plural is always also to be understood, and vice versa.

The sensor system thus measures the parking space, for example while the motor vehicle is driving past the space, in order to determine the dimension of the parking space.

According to a specific embodiment, the sensor system includes a processor that is fashioned to analyze the environmental sensor data in order to ascertain the state of occupancy, and/or the dimension, and/or the position of the parking space.

In a specific embodiment, it is provided that when an error is detected the sensor system is switched off.

In this way, for example the technical advantage is achieved that the sensor system can efficiently be prevented from providing results containing errors, such as incorrect states of occupancy. If such results are provided to other traffic participants, these participants could be misled by them, and could for example make a futile trip to a supposedly free parking space in order to park there. In this way, for example an unnecessary consumption of fuel can be avoided.

According to another specific embodiment, it is provided that when an error is detected an error message is outputted.

In this way, for example the technical advantage is achieved that for example a driver of the motor vehicle can efficiently be informed that the sensor system is operating incorrectly, and that the driver for example has to make an appointment with a repair facility. In this way, for example the technical advantage is achieved that the sensor system can quickly be repaired.

The outputting of the error message includes for example an outputting of an acoustic and/or optical and/or haptic error message.

In this way, for example the technical advantage is achieved that the driver can efficiently acquire the error message.

The outputting of the error message includes for example a sending of an error message via a communication network, for example to a terminal device, in particular a mobile terminal device, for example a mobile telephone.

In this way, for example the technical advantage is achieved that persons who are currently not in the motor vehicle can be efficiently informed about the error.

The terminal device is for example a server or a computer of a repair facility, and/or of a manufacturer of the sensor system, and/or of a manufacturer of the motor vehicle.

According to a specific embodiment, it is provided that the provision of the reference data set includes a reception of the reference data set via a wireless communication network during travel of the motor vehicle.

In this way, for example the technical advantage is achieved that the reference data set can be efficiently provided during travel.

For example, a server sends the reference data set to the motor vehicle via the wireless communication network.

In a specific embodiment, a communication interface is provided that is fashioned to communicate via a communication network, in particular a wireless communication network. This communication includes in particular a reception of the reference data set.

In a specific embodiment, a processor is provided that is fashioned to carry out the comparison.

In a specific embodiment, the device is the sensor system. That is, in particular the sensor system itself carries out the comparison. Errors in the sensor system standardly result from an incorrectly operating environmental sensor, and/or from an unclear acquisition, for example due to echoes (in a radar or ultrasound system) or shadows or reflections (in a video sensor), the actual comparison as a rule being a simple calculation that can be carried out correctly even by a sensor system that is operating incorrectly with regard to the acquisition of the state of occupancy.

According to a specific embodiment, the comparison is carried out externally to the sensor system, i.e., independently of the system. For example, the data ascertained by the sensor system, in particular the state of occupancy, and/or dimension, and/or position, of the parking space, are sent to a server, for example the server named above, via a wireless communication network, so that this server can carry out the comparison. Thus, the server in particular carries out the comparison.

That is, according to a specific embodiment it is provided that the comparison is carried out by the sensor system itself and/or is carried out externally to the sensor system.

Thus, in particular a combination is also provided: comparison by the sensor system and by the server.

Technical functionalities of the method result analogously from corresponding technical functionalities of the device, and vice versa.

Device features result analogously from corresponding method features, and vice versa.

A wireless communication network includes for example a WLAN communication network and/or a mobile radiotelephone communication network.

In a specific embodiment, it is provided that the motor vehicle is fashioned or set up to execute or carry out the method for testing for errors of a sensor system included in a motor vehicle for acquiring a state of occupancy of a parking space for motor vehicles.

In a specific embodiment, it is provided that the reference data set includes a reference position of the parking space, and when the motor vehicle is at the reference position a state of occupancy of the parking space situated at this location is acquired by the sensor system and is compared with the reference state of occupancy of the parking space in order to test the sensor system for errors.

That is, according to this specific embodiment the position of the parking space (reference position) is specified or provided, and when the vehicle is at this reference position a test is done, for example using the environmental sensor system, as to whether the state of occupancy of the parking space situated at the reference position corresponds to the reference state of occupancy.

In a specific embodiment, the motor vehicle includes a position sensor for determining a position of the motor vehicle.

In a specific embodiment, the sensor system includes a position sensor for determining a position of the motor vehicle.

According to a specific embodiment, a position sensor is a GPS sensor.

It is to be noted that the position sensor actually determines the position of the sensor system and/or of the motor vehicle. However, in the present description it is assumed that the spatial nearness of the sensor system to the parking space during the acquisition of the state of occupancy is such that, to a first approximation, the position of the sensor system and/or of the motor vehicle corresponds to the position of the parking space.

Below, the present invention is explained in detail on the basis of preferred exemplary embodiments.

DETAILED DESCRIPTION OF EXAMPLE EMBODIMENTS

Figure 1:
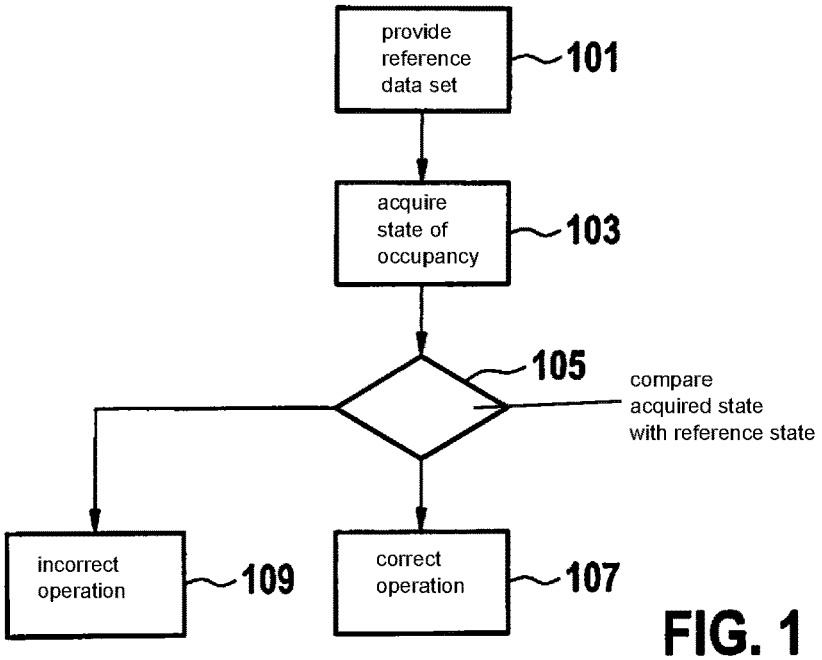
FIG. 1 shows a flow diagram of a method for testing for errors of a sensor system included in a motor vehicle for acquiring a state of occupancy of a parking space for motor vehicles.

FIG. 1 shows a flow diagram of a method for testing for errors of a sensor system included in a motor vehicle for acquiring a state of occupancy of a parking space for motor vehicles.

The method includes the following steps:

a provision 101 of a reference data set, ascertained independently of the sensor system to be tested, for a parking space, the reference data set including a reference state of occupancy of the parking space, an acquisition 103 of a state of occupancy of the parking space by the sensor system, and a comparison 105 of the acquired state of occupancy of the parking space with the reference state of occupancy, in order to test the sensor system for errors.

If comparison 105 yields the result that the acquired state of occupancy agrees with the reference state of occupancy, then in a step 107 it is determined that the sensor system is operating correctly, i.e. that no error has occurred.

If comparison 105 yields the result that the acquired state of occupancy and the reference state of occupancy are different from one another, i.e. do not agree, i.e. are unequal, then in a step 109 it is determined that the sensor system is operating incorrectly, i.e. that an error has occurred. In this case, it is for example provided that an error message, including a service indication, is outputted to the driver of the motor vehicle, the service indication including an indication that the sensor system has to be repaired. In this case it is for example provided that the sensor system is switched off.

Figure 2:
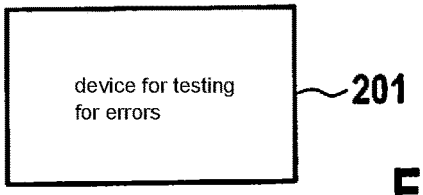
FIG. 2 shows a device for testing for errors of a sensor system included in a motor vehicle for acquiring a state of occupancy of a parking space for motor vehicles.

FIG. 2 shows a device 201 for testing for errors of a sensor system included in a motor vehicle for acquiring a state of occupancy of a parking space for motor vehicles, device 201 being fashioned to carry out the method for testing for errors of a sensor system included in a motor vehicle for acquiring a state of occupancy of a parking space for motor vehicles.

Device 201 includes for example a processor for comparing the acquired state of occupancy of the parking space to the reference state of occupancy in order to test the sensor system for errors.

Device 201 includes for example a communication interface that is fashioned to receive the reference data set via a wireless communication network.

Figure 3:
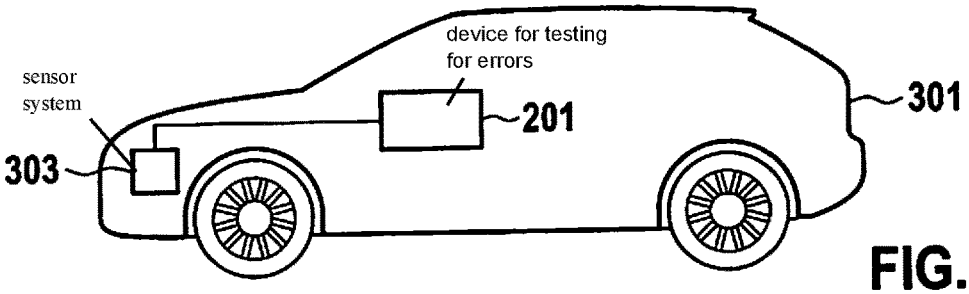
FIG. 3 shows a motor vehicle.

FIG. 3 shows a motor vehicle 301.

Motor vehicle 301 includes device 201 of FIG. 2.

Motor vehicle 301 further includes a sensor system 303 for acquiring a state of occupancy of a parking space for motor vehicles.

Sensor system 303 includes for example one or more environmental sensors (not shown) for acquiring a surrounding environment of motor vehicle 301.

Sensor system 303 includes for example a processor for analyzing environment sensor data corresponding to the surrounding environment of the motor vehicle acquired by the environmental sensor or environmental sensors, in order to ascertain the state of occupancy, and/or the dimension, of the parking space.

Sensor system 303 further includes a position sensor, for example a GPS sensor, for ascertaining the position of the parking space.

In a specific embodiment, device 201 corresponds to sensor system 303.

In sum, the design according to the present invention is in particular based on the feature that, on the basis of a parking space having a known position and known state of occupancy, it is tested whether a sensor system included in a motor vehicle for acquiring a state of occupancy of a parking space for motor vehicles is operating correctly or not. The knowledge of the known position and known state of occupancy of the parking space is ascertained independently of the sensor system to be tested. It is assumed that this knowledge is correct. This knowledge therefore forms the reference (reference data set).

The sensor system to be tested for example acquires the state of occupancy of the parking space while the motor vehicle is driving past the parking space, and/or measures the parking space in order to ascertain one or more dimensions of the parking space, and/or determines, or ascertains, a position of the parking space. The results (state of occupancy, dimension, position) ascertained by the sensor system to be tested are compared with the known knowledge, and should agree therewith if the sensor system to be tested is operating without error, i.e. correctly. Otherwise, i.e. if agreement is not present, i.e. there is a difference between the results of the sensor system and the known knowledge, the sensor system is for example switched off, and/or an error message is outputted.

What is claimed is:

1. A method for testing for errors of a sensor system included in a motor vehicle for acquiring a state of occupancy of a parking space for motor vehicles, comprising:

providing a reference data set, ascertained independently of the sensor system to be tested, for a parking space, the reference data set including a reference state of occupancy of the parking space;

acquiring a state of occupancy of the parking space by the sensor system; and comparing the acquired state of occupancy of the parking space with the reference state of occupancy in order to test the sensor system for errors.

2. The method as recited in claim 1, wherein the reference data set includes a reference position of the parking space, a position of the parking space being acquired by the sensor system, the acquired position of the parking space being compared with the reference position in order to test the sensor system for errors.

3. The method as recited in claim 1, wherein the reference data set includes a reference dimension of the parking space, a dimension of the parking space being acquired by the sensor system, the acquired dimension of the parking space being compared with the reference dimension in order to test the sensor system for errors.

4. The method as recited in claim 1, wherein the sensor system is switched off when an error is detected.

5. The method as recited in claim 1, wherein an error message is output when an error is detected.

6. The method as recited in claim 1, wherein the providing of the reference data set includes receiving the reference data set via a wireless communication network during travel of the motor vehicle.

7. The method as recited in claim 1, wherein the comparing is at least one of: (i) carried out by the sensor system itself, and (ii) carried out externally to the sensor system.

8. A device for testing for errors of a sensor system included in a motor vehicle for acquiring a state of occupancy of a parking space for motor vehicles, the device configured to:

provide a reference data set, ascertained independently of the sensor system to be tested, for a parking space, the reference data set including a reference state of occupancy of the parking space;

acquire a state of occupancy of the parking space by the sensor system; and compare the acquired state of occupancy of the parking space with the reference state of occupancy in order to test the sensor system for errors.

9. The device as recited in claim 8, wherein the device is included in a motor vehicle.

10. A non-transitory computer-readable storage medium on which is stored a computer program including program code for testing for errors of a sensor system included in a motor vehicle for acquiring a state of occupancy of a parking space for motor vehicles, the computer program, when executed by a computer, causing the computer to perform:

providing a reference data set, ascertained independently of the sensor system to be tested, for a parking space, the reference data set including a reference state of occupancy of the parking space;

acquiring a state of occupancy of the parking space by the sensor system; and comparing the acquired state of occupancy of the parking space with the reference state of occupancy in order to test the sensor system for errors.

* * * * *